US009027763B2

(12) United States Patent
Kotesky

(10) Patent No.: US 9,027,763 B2
(45) Date of Patent: May 12, 2015

(54) NO VAULT PUMP FILTER

(71) Applicant: GAG Sim/Tech Filters, Inc., Boyne City, MI (US)

(72) Inventor: Gary L. Kotesky, Boyne City, MI (US)

(73) Assignee: Sim-Tech Filters, Inc., Boyne City, MI (US)

( * ) Notice: Subject to any disclaimer, the term of this patent is extended or adjusted under 35 U.S.C. 154(b) by 130 days.

(21) Appl. No.: 13/796,831

(22) Filed: Mar. 12, 2013

(65) Prior Publication Data

US 2013/0251554 A1 Sep. 26, 2013

Related U.S. Application Data

(60) Provisional application No. 61/615,406, filed on Mar. 26, 2012.

(51) Int. Cl.
*F04D 29/60* (2006.01)
*F04D 29/70* (2006.01)

(52) U.S. Cl.
CPC ..... *F04D 29/60* (2013.01); *F04D 29/605* (2013.01); *F04D 29/708* (2013.01)

(58) Field of Classification Search
USPC ..... 417/423.3; 210/416.1–416.5
See application file for complete search history.

(56) References Cited

U.S. PATENT DOCUMENTS

| | | | | |
|---|---|---|---|---|
| 4,273,520 | A | 6/1981 | Sutliff et al. | |
| 4,416,591 | A * | 11/1983 | Horwinski | 417/241 |
| 5,262,065 | A | 11/1993 | Hansen | |
| 5,348,442 | A | 9/1994 | Harris et al. | |
| 5,651,666 | A | 7/1997 | Martin | |
| 6,261,452 | B1 * | 7/2001 | Mayer | 210/256 |
| 6,416,664 | B1 | 7/2002 | Bovington | |
| 6,773,606 | B2 | 8/2004 | Wilkins et al. | |
| 7,513,755 | B2 | 4/2009 | Geisinger et al. | |
| 7,837,450 | B2 | 11/2010 | Moreland | |
| 7,976,713 | B2 | 7/2011 | Ball | |
| 8,079,829 | B2 | 12/2011 | Geisinger et al. | |
| 2006/0016744 | A1 * | 1/2006 | Miner | 210/416.1 |
| 2008/0190509 | A1 * | 8/2008 | Cox | 138/96 R |
| 2009/0173673 | A1 * | 7/2009 | Pritchard | 210/85 |

* cited by examiner

*Primary Examiner* — Chester Barry
(74) *Attorney, Agent, or Firm* — Brinks Gilson & Lione

(57) ABSTRACT

A pump filter system for use with a submersible pump assembly including a base cup having an outer peripheral flange and an upwardly extending ring concentrically located within and spaced from the peripheral flange. A self-supporting, substantially uniformly perforated, tubular wall portion having a lower end coupled to the base cup outer peripheral flange and an upper end surrounding a pump discharge conduit connection. A tubular sleeve having a lower end contiguous with an upper portion of the pump body and an upper end projecting above the discharge conduit connection. A tapered coupling having a lower end connected to the perforated tubular wall upper end and an upper end connected to the tubular sleeve upper end, and a seal ring surrounding the discharge conduit connection and the tubular sleeve inner surface.

11 Claims, 2 Drawing Sheets

NO VAULT PUMP FILTER

CROSS-REFERENCE TO RELATED APPLICATIONS

The present invention is related to and claims all available benefit of provisional application 61/615,406, filed Mar. 26, 2013.

BACKGROUND

The present invention relates to pump filter assemblies useful in water discharge systems leading from a chamber from which filtered liquid can be pumped. The present invention relates particularly to a light weight apparatus for filtering and pumping wastewater from a secondary treatment tank. The present system can also be used in water collection cisterns, irrigation systems, or in any other fluid system where light filtration is desired.

Bodies of water are often used for decorative purposes as in gardens and ponds, for industrial purposes as in fish hatcheries, ranching, industrial recycling, and even for municipal water supplies as well as for recreational purposes. Most of these bodies of water must be maintained to prevent stagnation or contamination of the water. This is especially true if the water is to be consumed. However, it is also desirable to maintain a body of water simply to prevent formation of insect breeding areas. Therefore, there is a need for a filter unit system which can be used on a large body of water such as a pond, which is also adaptable for use on smaller bodies of water such as secondary treatment tanks in wastewater systems.

If a body of water is to be used for decorative purposes, such as in landscaping, the filter system used to maintain that body of water should not be conspicuous. That is, if a filter unit is located where it can be seen, it may detract from the overall aesthetic appeal of such a decorative body of water. Locating a filter unit in an inconspicuous location may require conduits to be buried and pumps to be sufficiently powerful to move water great distances. Any filter system should be easy to set up and maintain. otherwise, the filter systems may become ineffective due to improper maintenance.

Therefore, there is a need for a filtration system that is easy to set up and maintain. There is also a need for a filtration system that can be set up in a variety of locations yet will be inconspicuous and still be cost effective.

SUMMARY

These needs are satisfied by a pump filter system that can take the form of a submersible pump assembly including a pump having a body with at least one liquid intake port. A discharge conduit can be connected to the pump body. A motor can be coupled to the pump. A related filter system can include a base cup having an outer peripheral flange. The base cup can have an upwardly extending ring concentrically located within and spaced from the peripheral flange. A self-supporting, substantially uniformly perforated, tubular wall portion can have a lower end coupled to the base cup outer peripheral flange. The tubular wall portion can have an upper end surrounding the connection between the discharge conduit and the pump body. A tubular sleeve can have a lower end situated generally contiguously with at least an upper portion of the pump body. The tubular sleeve can have an upper end projecting above the connection between the discharge conduit and the pump body. A tapered coupling can have a lower end connected to the perforated tubular wall upper end. An upper end of the tapered coupling can be connected to the tubular sleeve upper end. A seal ring can be positioned to have an inner edge surrounding the connection between the discharge conduit and the pump body and an outer edge abutting the tubular sleeve inner surface.

In another aspect, a pump and filter assembly can include a submersible pump including a pump body containing a fluid impeller with at least one liquid intake port and an outlet port. A discharge conduit can be connected to the pump outlet port. A motor can be coupled to the pump body and to the fluid impeller. A base cup can have an outer peripheral flange and an upwardly extending ring concentrically located within and spaced from the peripheral flange. A lower end of the pump motor can be received within the upwardly extending ring of the base cup. A tubular sleeve can have a lower end situated substantially contiguously with at least an upper portion of the pump body. An upper end of the tubular sleeve can project above the pump outlet port. A tapered coupling can have an upper end connected to the tubular sleeve upper end. A lower end of the tapered coupling can be located so as to be concentric to and positioned above the base cup peripheral flange. A seal ring can have an inner edge surrounding the connection between the discharge conduit and the pump outlet port. An outer edge of the seal ring can abut the tubular sleeve inner surface. A self-supporting, substantially uniformly perforated, tubular wall portion can have a lower end coupled to the base cup outer peripheral flange. An upper end of the substantially uniformly perforated, tubular wall portion can be coupled to the tapered coupling lower end.

In either aspect, the perforations extending through the wall portion can occupy 40% or more of the total area of the tubular wall portion. The tubular wall portion can be made from a variety of materials, for example, PVC plastic or stainless steel. The base cup peripheral flange preferably extends upward at least 5 cm from the bottom of the base cup. The base cup peripheral flange preferably surrounds the outer surface of the tubular wall portion. The tapered coupling lower end preferably surrounds the tubular wall portion upper end. The liquid intake port can be situated between the motor and the pump body.

A secondary filter can be situated within the tubular wall portion and surrounding the pump body, the at least one liquid intake port and the motor. The secondary filter can take the form of, for example, a sock filter or a pleated filter. A plurality of suspension elements can be fixed to the tapered coupling upper end to facilitate removal of the apparatus. A tubular bell can be included that has an upper end coupled to the tubular sleeve and a lower end spaced above the base cup upwardly extending ring. The tubular bell can act to enhance the flow of liquid along the motor body so as to prolong the durability of the motor during long pumping cycles.

Other features and the corresponding advantages of those features will be come apparent from the following discussion of the preferred embodiments of the present invention, exemplifying the best mode of practicing the present invention, which is illustrated in the accompanying drawings. The components in the figures are not necessarily to scale, emphasis instead being placed upon illustrating the principles of the invention. Moreover, in the figures, like referenced numerals designate corresponding parts throughout the different views.

DESCRIPTION OF PREFERRED EMBODIMENTS

Figure 1:
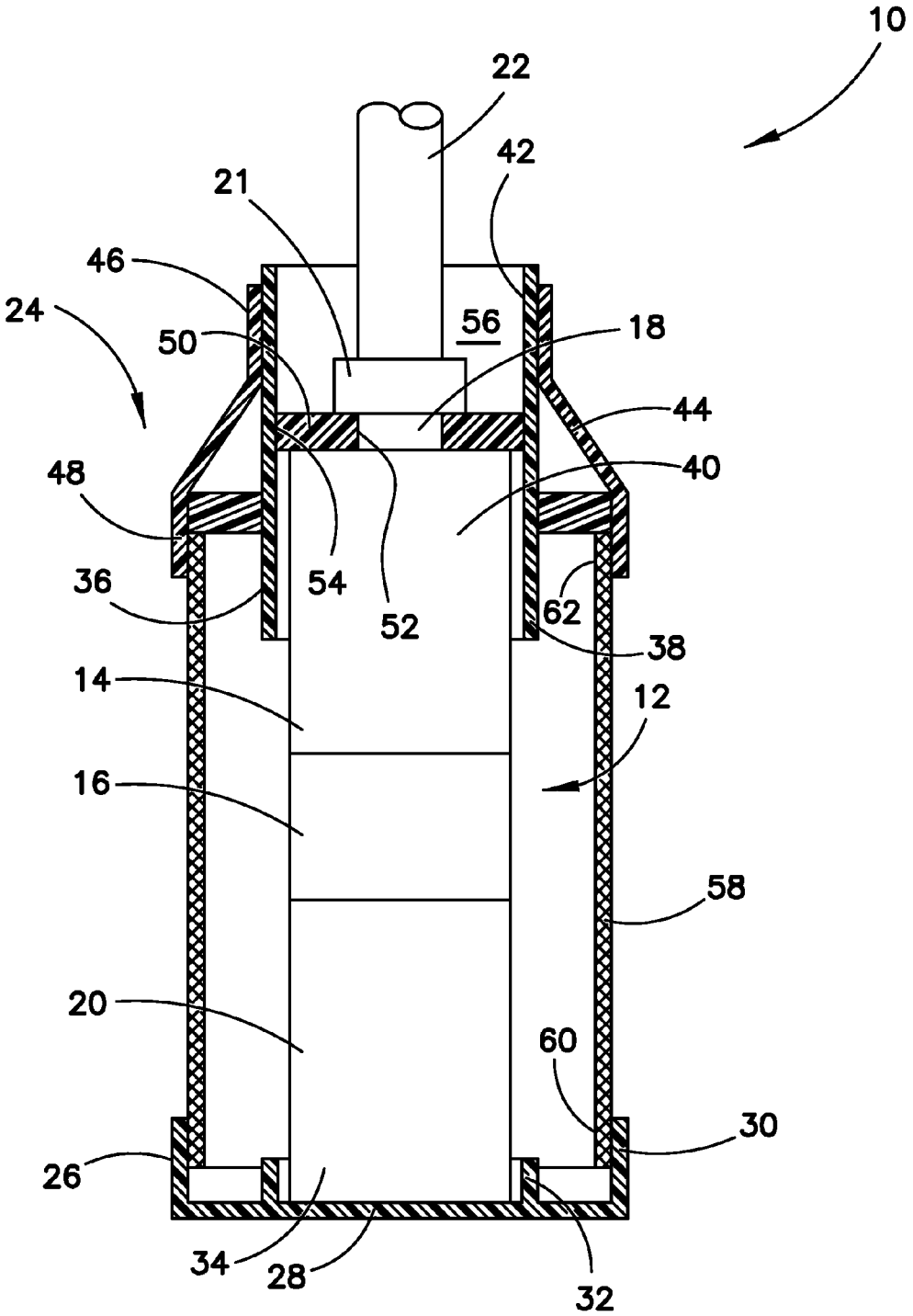
FIG. 1 is a schematic sectional view of a first embodiment of a pump filter assembly.

As shown, for example in FIG. 1, a pump and filter assembly 10 can include a submersible pump 12 including a pump body 14 containing a fluid impeller with at least one liquid intake port 16 and an outlet port 18. A motor 20 can be coupled to the pump body 14 and to the fluid impeller. The liquid intake port 16 can be situated between the motor 20 and the pump body 14. The pump 12, pump body 14, intake port 16, outlet port 18 and motor 20 can be purchased commercially as a unit from a variety of sources, such as, for example, a Red Lion model RL12G05 deep well submersible pump. A discharge conduit 22 can be connected to the pump outlet port 18 by coupling 21 and extend upward to any desirable location.

A filter assembly 24 can envelop the pump 12, pump body 14, intake port 16, outlet port 18 and motor 20. The filter assembly 24 can include a base cup 26 that has a base 28, an outer peripheral flange 30, and an upwardly extending ring 32 concentrically located within and spaced from the peripheral flange 30. A lower end 34 of the pump motor 20 can be received within the upwardly extending ring 32 of the base cup 26. The filter assembly 24 can also include a tubular sleeve 36. The tubular sleeve 36 can have a lower end 38 situated substantially contiguously with at least an upper portion 40 of the pump body 14. An upper end 42 of the tubular sleeve 36 can project above the pump outlet port 18. The filter assembly 24 can also include a tapered coupling 44. The tapered coupling 44 can have an upper end 46 connected to the tubular sleeve upper end 42. A lower end 48 of the tapered coupling 44 can be located so as to be concentric to and positioned above the base cup peripheral flange 30. The filter assembly 24 can also include a seal ring 50. The seal ring 50 can have an inner edge 52 surrounding the connection between the discharge conduit 22 and the pump outlet port 18. An outer edge 54 of the seal ring 50 can abut an inner surface 56 of the tubular sleeve 36.

The filter assembly 24 can also include a self-supporting, tubular wall portion 58 that is substantially uniformly perforated so as to allow liquid to penetrate the wall portion 58. The substantially uniformly perforated, tubular wall portion 58 can have a lower end 60 coupled to the outer peripheral flange 30 of the base cup 26. An upper end 62 of the substantially uniformly perforated, tubular wall portion 58 can be coupled to the lower end 48 of the tapered coupling 44. The perforations of the tubular wall portion 58 can occupy 40% or more of the total area of the tubular wall portion 58. The tubular wall portion 58 can be made from a variety of materials, for example, PVC plastic or stainless steel. The peripheral flange 30 of the base cup 26 preferably extends upward at least 5 cm from the bottom 28 of the base cup. The base cup peripheral flange 30 preferably surrounds the outer surface of the tubular wall portion 58. The tapered coupling lower end 48 preferably surrounds the tubular wall portion upper end 62.

Figure 2:
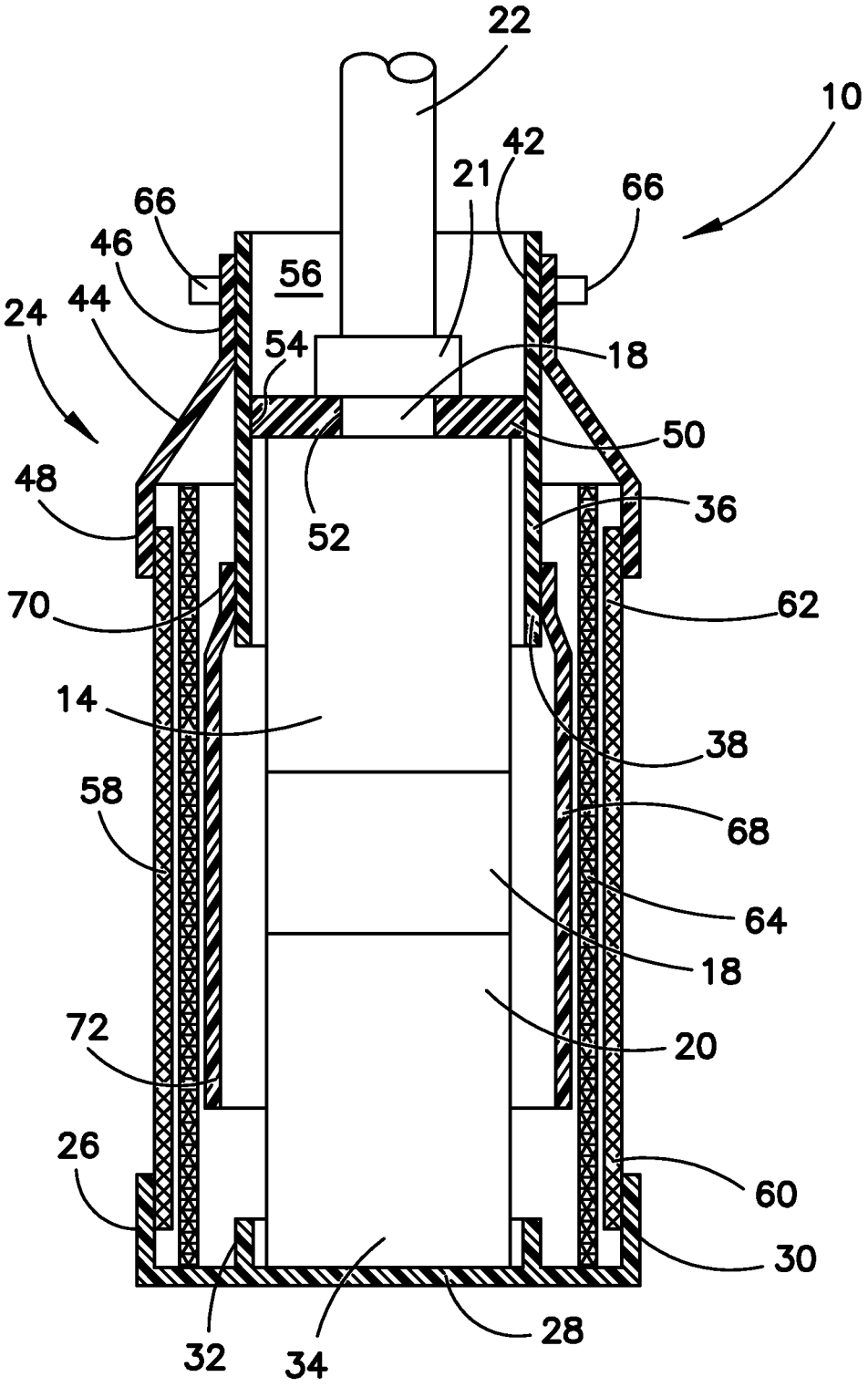
FIG. 2 is a schematic sectional view of a second embodiment of a pump filter assembly.

As shown in FIG. 2, a secondary filter 64 can be situated within the tubular wall portion 58 to surround the pump body 14, intake port 16, and motor 20. The secondary filter 64 can take the form of, for example, a sock filter or a pleated filter. A plurality of suspension elements 66 can be fixed to the upper end 46 of the tapered coupling 44 to facilitate removal of the pump and filter assembly 10 from a given installation. The filter assembly 24 can also include a tubular bell 68. The tubular bell 68 can have an upper end 70 coupled to the tubular sleeve 36 and a lower end 72 spaced above the upwardly extending ring 32 of the base cup 28. The tubular bell 68 can act to enhance the flow of liquid along the outside surface of the motor 20 so as to prolong the durability of the motor particularly in the event of long pumping cycles.

While these features have been disclosed in connection with the illustrated preferred embodiments, other embodiments of the invention will be apparent to those skilled in the art that come within the spirit of the invention as defined in the following claims.

What is claimed is:

1. A pump filter system for use with a submersible pump assembly including a pump having a pump body with at least one liquid intake port, a liquid discharge conduit connected to the pump body, and a motor coupled to the pump body, the filter system comprising: a base cup having an outer peripheral flange and an upwardly extending ring concentrically located within and spaced from the peripheral flange; a self-supporting, substantially uniformly perforated, tubular wall portion having a lower end coupled to the base cup outer peripheral flange and an upper end surrounding the connection between the liquid discharge conduit and the pump body; a tubular sleeve having a lower end situated generally contiguously with at least an upper portion of the pump body and an upper end projecting above the connection between the liquid discharge conduit and the pump body; a tapered coupling having a lower end connected to the perforated tubular wall upper end and an upper end connected to the tubular sleeve upper end; and a seal ring having an inner edge surrounding the connection between the liquid discharge conduit and the pump body and an outer edge abutting the tubular sleeve inner surface.

2. A pump and filter assembly comprising:

a submersible pump including a pump body containing a fluid impeller with at least one liquid intake port and an outlet port, a liquid discharge conduit connected to the pump outlet port, and a motor coupled to the pump body; a base cup having an outer peripheral flange and an upwardly extending ring concentrically located within and spaced from the peripheral flange, a lower end of the pump motor being received within the upwardly extending ring; a tubular sleeve having a lower end situated substantially contiguously with at least an upper portion of the pump body and an upper end projecting above the pump outlet port; a tapered coupling having an upper end connected to the tubular sleeve upper end and a lower end concentric to and positioned above the base cup peripheral flange; a seal ring having an inner edge surrounding the connection between the liquid discharge conduit and the pump outlet port and an outer edge abutting the tubular sleeve inner surface; and a self-supporting, substantially uniformly perforated, tubular wall portion having a lower end coupled to the base cup outer peripheral flange and an upper end coupled to the tapered coupling lower end.

3. The apparatus of claim 1 or 2, wherein the tubular wall portion perforations occupy at least 40% of the total area of the tubular wall portion.

4. The apparatus of claim 3, wherein the tubular sleeve is composed of PVC plastic or stainless steel.

5. The apparatus of claim 3, wherein the base cup peripheral flange extends upward at least 5 cm from the bottom of the base cup and surrounds the outer surface of the tubular wall portion.

6. The apparatus of claim 5, wherein the tapered coupling lower end surrounds the tubular wall portion upper end.

7. The apparatus of claim 3, wherein the at least one liquid intake port is situated between the motor and the pump body.

8. The apparatus of claim 3, further comprising a secondary filter situated within the tubular wall portion and surrounding the pump body, the at least one liquid intake port and the motor.

9. The apparatus of claim 3, further comprising a plurality of suspension elements fixed to the tapered coupling upper end to facilitate removal of the apparatus.

10. The apparatus of claim 3, further comprising a tubular bell having an upper end coupled to the tubular sleeve and a lower end spaced above the base cup upwardly extending ring.

11. The apparatus of claim 1 or 2, wherein the motor is electrically powered.

* * * * *